US009954322B2

(12) United States Patent
Gebhardt et al.

(10) Patent No.: US 9,954,322 B2
(45) Date of Patent: Apr. 24, 2018

(54) CONNECTION TERMINAL

(71) Applicant: Phoenix Contact GmbH & Co. KG, Blomberg (DE)

(72) Inventors: Martin Gebhardt, Porta Westfalica (DE); Dennis Habirov, Bielefeld (DE); Christian Kloppenburg, Büren Wewelsburg (DE); Thorsten Schloo, Detmold (DE); Olaf Schyrocki, Bad Pyrmont (DE); Dennis Sprenger, Horn-Bad Meinberg (DE); Marcel Willems, Blomberg (DE)

(73) Assignee: Phoenix Contact GmbH & Co. KG, Blomberg (DE)

( * ) Notice: Subject to any disclaimer, the term of this patent is extended or adjusted under 35 U.S.C. 154(b) by 66 days.

(21) Appl. No.: 14/401,325

(22) PCT Filed: May 8, 2013

(86) PCT No.: PCT/EP2013/001361
§ 371 (c)(1),
(2) Date: Nov. 14, 2014

(87) PCT Pub. No.: WO2013/170942
PCT Pub. Date: Nov. 21, 2013

(65) Prior Publication Data

US 2015/0147909 A1 May 28, 2015

(30) Foreign Application Priority Data

May 14, 2012 (DE) ..... 10 2012 009 493
Jun. 14, 2012 (DE) ..... 10 2012 011 676

(51) Int. Cl.
*H01R 13/60* (2006.01)
*H01R 13/73* (2006.01)
(Continued)

(52) U.S. Cl.
CPC ..... *H01R 13/73* (2013.01); *H01R 9/2408* (2013.01); *H01R 13/582* (2013.01); *H01R 13/74* (2013.01)

(58) Field of Classification Search
CPC ..... H01R 13/582; H01R 13/73; H01R 9/2408
(Continued)

(56) References Cited

U.S. PATENT DOCUMENTS 5,631,454 A * 5/1997 Hubacher ..... B60K 37/06 200/296
7,090,526 B2 * 8/2006 Monte ..... H01R 13/745 439/357
(Continued)

FOREIGN PATENT DOCUMENTS

DE 36 13 681 C1 6/1987
DE 198 01 260 A1 7/1999
(Continued)

OTHER PUBLICATIONS

EP 133544 Translation. Guenter. Feed-through terminal block for electrical conductors.*

*Primary Examiner* — Michael A Lyons
*Assistant Examiner* — Milagros Jeancharles
(74) *Attorney, Agent, or Firm* — David S. Safran

(57) ABSTRACT

A connection terminal having a terminal housing for securing a terminal block arrangement having a plurality of terminal blocks in a wall opening of a housing wall, and a construction unit having two connection terminals and a terminal block arrangement that are formed of a plurality of adjacently arranged terminal blocks. The connection terminal enables the terminal blocks and/or the terminal block arrangement to be mounted and/or dismounted from one side in a wall opening of a housing wall by displaceably arranging a securing element in the terminal housing, the securing element having a terminal bevel that protrudes
(Continued)

through an opening in the terminal housing, and by movably disposing the securing element with the aid of an actuation element into a terminal position in which the terminal bevel acts against an inner edge of the wall opening in the mounted state of the connection terminal.

16 Claims, 6 Drawing Sheets

(51) Int. Cl.
*H01R 9/24* (2006.01)
*H01R 13/74* (2006.01)
*H01R 13/58* (2006.01)

(58) Field of Classification Search
USPC ..... 439/101, 317, 458, 459, 467, 529, 439/544–576, 708, 709, 721–723, 729, 439/859; 174/661–663
See application file for complete search history.

(56) References Cited

U.S. PATENT DOCUMENTS

| | | | | |
|---|---|---|---|---|
| 7,537,496 | B2 * | 5/2009 | Bentler | H01R 9/2491 439/532 |
| 7,666,037 | B2 * | 2/2010 | Diessel | H01R 9/2616 439/716 |
| 7,884,597 | B2 | 2/2011 | Ostmeier | |
| 9,153,916 | B2 * | 10/2015 | Schloo | H01R 9/2491 |
| 2009/0305540 | A1 * | 12/2009 | Stadler | H01R 13/514 439/310 |

FOREIGN PATENT DOCUMENTS

| | | | | |
|---|---|---|---|---|
| DE | 202 00 974 | U1 | 7/2003 | |
| DE | 10 2005 025 108 | B3 | 7/2006 | |
| DE | 20 2010 010 424 | U1 | 12/2011 | |
| DE | 10 2011 113 333 | A1 | 3/2013 | |
| EP | 1333544 | A1 * | 8/2003 | H01R 13/743 |

* cited by examiner

CONNECTION TERMINAL

BACKGROUND OF THE INVENTION

Field of the Invention

The invention relates to a connection terminal with a clip housing for fixing a modular terminal block which has several modular terminals in an opening of a housing wall. In addition, the invention relates to a unit having two connection terminals and several modular terminals which are located next to one another.

Description of Related Art

Electrical modular terminals have been known for decades and are used millions of times in the wiring of electrical systems and devices. The terminals are often locked onto mounting rails which, for their part, several terminals can be arranged in a switchgear cabinet. But, in addition, the modular terminals can also be mounted alone or in general severally as a modular terminal block in a wall opening, in particular in an opening of a switchgear cabinet wall. This has the advantage that one side of the terminals, the operator side, is accessible from outside the switchgear cabinet, without the switchgear cabinet having to be opened, and only the other side of the terminal, the connection side, is accessible only with the switchgear cabinet opened.

In modular terminals, mostly screw-type terminals or tension spring terminals are used as conductor connecting elements. The clamping principle in tension spring terminals is similar to that of screw technology. While in the screw-type terminal a tension sleeve pulls the conductor against the busbar by activating the terminal screw, in the tension spring terminal its task is assumed by the tension spring. In addition, however, also insulation piercing terminals or torsion spring terminals can be used.

Electrical modular terminals are generally connecting terminals so that they have at least two conductor connecting elements which are electrically connected to one another via an electrically conductive connecting bar, the busbar. In addition to this basic type of modular terminals, which is also often called a feed-through terminal, there are a host of different modular terminal types which are adapted especially to the respective applications (compare Phoenix Contact Catalog Modular Terminal CLIPLINE 2011, pp. 2-11). Examples here are protective conductor terminals, isolating blade terminals, and installation terminals.

In switching, measurement and control technology, feed-through terminals with an isolating capacity are the standard. The isolating possibility which is implemented in the electrical modular terminal, i.e., the isolating point which is provided in the busbar, makes it possible to plug different plugs with different functions into the terminal housing of the modular terminals which then make contact with the busbar at the isolating point. In addition to simple isolating plugs or through connectors, in particular, test plugs can also be used which can have special components and which enable checking of the proper operation of the circuit which is connected to the modular terminal. Since electrical modular terminals are generally made disk-shaped, they are generally mated to several other electrical modular terminals to form a modular terminal block. Then, a number of test plugs which corresponds to the number of modular terminals can be plugged into this modular terminal block.

A device is disclosed in German Patent Application DE 10 2005 025 108 B3 for testing of a protective, measurement or counting apparatus, for example, a line protective relay, which has a pole strip which can be connected to the electrical apparatus with several successively arranged pole openings and a plug block with a number of pole tongues which corresponds to the number of pole openings. An individual pole strip module of the pole strip consists of a housing in which there are two jacks for connection of lines and spring-loaded contact clips which are connected to the jacks. The pole tongue of one plug can make contact with the two contact clips, the pole tongue of the plug having two pole bars which are separated from one another by an insulating bar. The insulating bar together with the corresponding pole openings in the pole strip module forms polarization which ensures that only one plug with a certain pole tongue can be inserted into a certain pole opening of a pole strip.

When the plug or the pole tongue has not been plugged into the pole strip, the two contact clips make contact with one another so that the two jacks are connected to one another in an electrically conductive manner and current can flow via a connected pole strip. If the plug with its pole tongue is inserted completely into the pole opening, the two contact clips are electrically separated from another and the current flow is routed via the plug so that a test process can be carried out.

German Patent Application DE 10 2006 052 894 A1 and corresponding U.S. Pat. No. 7,666,037 B2 disclose a modular terminal, a test plug and a test terminal block having a plurality of modular terminals which are located next to one another and a corresponding number of test plugs, the individual modular terminals and the individual test plugs being similar in basic principle to the pole strip modules and pole plugs which are known from German Patent Application DE 10 2005 025 108 B3.

In order to ensure defined contact states when the test plug is plugged into the test opening, in these known electrical modular terminals the busbars are made such that they form two contact regions which are located in succession in the insertion direction of one test plug. Forming a defined second contact region which is located in the insertion direction of the contact plug upstream of the first contact region ensures that when the contact plug is inserted first a reliable electrical connection between the contact plug and the two busbars is formed before the first contact region is opened as the contact plug continues to be inserted, as a result of which the two busbars are then electrically isolated from one another.

It is common to the above described known modular terminals and test terminal blocks that the two busbars make contact with one another so that the conductor connecting elements are connected to one another in an electrically conductive manner if a plug has not been plugged into the modular terminal. Conversely, if a plug has been (completely) plugged into the modular terminal, the contact region is interrupted so that the conductor connecting elements are also electrically isolated from one another.

In addition to these modular terminals and test terminal blocks, test isolating blocks are also known from practice, in particular those from the Russian company Cheaz which are very common in Eastern Europe and Russia, in which the elastic contact sections of the busbars which together form an elastic contact region are spaced apart from one another and are connected to one another in an electrically conductive manner only when a plug of a service plug or test plug is plugged into the contact region. The electrically conductive connection between the contact sections and between the busbars takes place via the inserted plug which for this purpose has two interconnected contact sections which make contact with the contact sections of the busbars when the plug has been plugged in.

In these test isolating blocks, the conductor connecting elements assigned to one another are thus only connected to one another in an electrically conductive manner when a corresponding service plug is plugged into the modular terminal or into the terminal block. These modular terminals or terminal blocks are used in particular for connection of current transformers. One important operating feature is that the current transformers are short circuited as soon as the test plug or service plug is pulled out of the modular terminal or the terminal block. To do this, in the known test isolating blocks, there are jumper plugs via which at least two adjacent busbars are connected to one another in an electrically conductive manner so that the assigned conductor connecting elements are short circuited. In this way, then, the current transformers which are connected to the conductor connecting elements are also short circuited.

In these test terminal blocks which are known from the prior art, the jumper plugs ensure an electrically conductive connection between adjacent contact sections or busbars. This cross bridging is automatically interrupted when a test plug or service plug is plugged in, at the same time the contact sections which are assigned to one another being connected to one another in an electrically conductive manner via the plug.

Regardless of how the modular terminals are made, in particular, whether as connecting terminals or feed-through terminals with an isolating possibility and regardless of whether the busbars make contact in feed-through terminals with an isolating possibility and thus the conductor connecting elements are connected to one another in an electrically conductive manner when a plug is plugged into the modular terminal, or whether the busbars are spaced apart from one another and are only connected to one another in an electrically conductive manner when a plug has been plugged into the contact region, these modular terminals are often arranged severally next to one another and are mechanically connected to one another so that together they form a modular terminal block.

In contrast to "normal" modular terminals, especially the above described test terminals or test terminal blocks are often not locked on a mounting rail, but in an opening of a housing wall, for example, a switchgear cabinet door or a switchgear cabinet wall.

In this connection, it is known for two-part terminals, for example, from German Patent DE 36 13 681 C1, that the two parts of the electrical terminal have catch elements which correspond to one another and which, when the two terminal parts are inserted into one another, interlock with one another and prevent isolation of the two terminal parts against the insertion direction. To do this, the two parts of the terminal must be plugged in the opposite direction through the wall opening in the housing wall so that the housing wall is clamped between the parts of the terminal. The disadvantage of this type of mounting of a terminal in a wall opening is that, on the one hand, the terminal itself must be made in two parts, on the other, the mounting and dismounting of the terminal in the wall opening takes place from the two sides.

German Patent DE 198 01 260 C2 discloses a modular terminal in which a one-piece terminal housing is routed through the wall opening up to a stop and then a notch lever is slipped onto the part which has been routed through the wall opening. The notch lever in doing so interlocks with two opposite sides of the housing so that the housing wall is fixed between the stop on one side and the notch lever on the other side. In doing so the housing wall must be accessible on both sides for mounting.

German Utility Model DE 202 00 974 U1 discloses a modular terminal in which the one-piece terminal housing is inserted through the wall opening of a housing, when the terminal housing is pushed through the wall opening spring catches provided on two opposite sides of the housing each being displaced back by one inside edge of the wall opening. For final fixing of the terminal in the wall opening, the spring catches must be prevented from springing back again by a blocking slide which can only be operated from the inside of the housing, while the terminal must first be inserted from the outside of the wall opening so that access to the two sides of the housing wall during mounting is also necessary here.

SUMMARY OF THE INVENTION

Therefore, the object of this invention is to make available a mounting possibility for modular terminals, especially for a modular terminal block which consists of several modular terminals and which enables unilateral mounting and dismounting of the modular terminals or of the modular terminal block in one wall opening of one housing wall. Moreover, reliable mounting in the wall opening must also be ensured for tolerances of the dimensions of the wall opening and the wall thickness.

This object is achieved in the initially described type of connection terminal in that there is a movable fixing element in the clip housing which has a clamping bevel which projects through an opening in the clip housing, and that the fixing element can be moved using an actuating element into a clamping position in which the clamping bevel in the mounted state of the connection terminal acts against an inside edge of the wall opening. The mounting and dismounting of the connection terminal in the wall opening takes place only from one side, specifically from the side from which the actuating element can be actuated to move the fixing element. From this side, the connection terminal is first inserted into the wall opening before the connection terminal is fixed in the wall opening by moving the fixing element into the clamping position.

In contrast to the above described approaches which are known from the prior art, the individual modular terminals or the modular terminal block is not fixed in the wall opening, in any case not primarily, via catch elements made on the individual modular terminals, but via separate connection terminals which are generally located on the two sides of the modular terminal block which formed of several modular terminals. This has, first of all, the advantage that the modular terminals in the blocked state, i.e., the modular terminal block altogether, can be more easily mounted in the wall opening than is the case for a modular terminal block which is composed of several modular terminals which each have a fixing element.

Moreover, the movable arrangement of the fixing element in the terminal housing makes it possible to mount and dismount the modular terminal block from one side of the housing wall, generally from the wiring side. The clamping of the connection terminal and thus also of the modular terminal block in one wall opening takes place via the clamping bevel of the fixing element which is moved for this purpose using an actuating element into the clamping position in which the clamping bevel acts against the inside edge of the wall opening. Because the clamping surface is made as a bevel, the connection terminal can be inserted in the wall opening with—within a certain range—different dimensions, i.e., for wall openings with relatively large dimensional tolerances.

So that the connection terminal is fixed in the wall opening of the housing wall in the clamping position of the fixing element, both in the vertical and also in the horizontal direction, on the clip housing preferably a contact surface which is opposite the clamping bevel of the fixing element is made and extends parallel to the housing wall. The housing wall is thus clamped between the clamping bevel and the contact surface which is used as the stop when the clip housing is inserted through the wall opening when the fixing element is moved into its clamping position using the actuating element.

The displacement of the fixing element can preferably be especially easily enabled by there being a screw as the actuating element in a hole in the clip housing, which hole is accessible from the outside, and by there being a nut locked against rotation in the fixing element. The end of the screw is screwed into the nut and the hole is made such that the screw is fixed in the longitudinal direction so that twisting of the screw does not lead to an axial movement of the screw, but to a displacement of the fixing element in the longitudinal direction of the screw. After the connection terminal has been inserted through the opening of the housing wall up to the stop, the clamping bevel which projects through the opening in the clip housing being located on the side of the housing wall opposite the contact surface, by twisting the screw the fixing element can be drawn against the opposite inside edge of the wall opening so that the housing wall is clamped between the contact surface and the clamping bevel of the fixing element. In order to facilitate the insertion of the connection terminal into the wall opening, preferably on the side opposite the clamping bevel, the fixing element has an lead-in bevel so that the connection terminal can be easily pivoted into the housing wall opening with a slight tilting motion.

According to another advantageous configuration of the connection terminal in accordance with the invention, in the clip housing on the side opposite the opening for the clamping bevel, an insertion bevel is made with which the clip housing in the mounted state of the connection terminal sits on the lower inside edge of the wall opening. The connection terminal is fixed in the mounted state not only in the horizontal direction by the clamping of the upper inside edge of the wall opening between the contact surface and the clamping bevel, but additionally in the vertical direction by the clip housing being pressed in the vertical direction with its insertion bevel against the lower inside edge of the wall opening via the clamping bevel of the fixing element. Moreover the execution of the insertion bevel on the bottom of the clip housing also ensures reliable preliminary mounting of the connection terminal in the wall opening without the risk of the connection terminal falling out of the wall opening when the fixing element has not yet been moved in its clamping position. To do this, the connection terminal is pivoted into the wall opening and is then lowered onto the insertion bevel. The clamping bevel which projects through the opening in the clip housing prevents the connection terminal from falling out, even if the fixing element has not yet been moved into its clamping position.

As was stated above, the connection terminal in accordance with the invention is used to mount several modular terminals which form a modular terminal block in one housing wall opening. The invention thus also relates to a unit having two connection terminals in accordance with the invention and several modular terminals which are located next to one another, the modular terminals being located between the connection terminals and having one terminal housing at a time with at least two conductor connection elements which are located therein. These modular terminals are fundamentally known from the prior art in the most varied versions. Preferably, the modular terminals here are feed-through terminals with an isolation capacity so that one test plug at a time can be plugged into the individual modular terminals.

The modular terminals which are used in the unit in the preferred embodiment of the invention each have at least two busbars which are located in the terminal housing and which have one connection section and one contact section each, the connection sections each being assigned to one conductor connection element, while the contact sections together form an elastic contact region for accommodating the plug of a test plug or service plug. So that this plug can be plugged into the elastic contact region, in the terminal housings of the modular terminal one opening at a time is made which is accessible from one side, the operator side.

The electrical modular terminals which together form the modular terminal block, are each made disk-shaped. So that several modular terminals together can form a modular terminal block, the individual modular terminals are mechanically joined to one another, for which the modular terminals are locked together via corresponding catch elements which are made in the terminal housing. The catch elements preferably formed of drop-in pins which are located on one side of the terminal housing and corresponding catch recesses which are made on the other side of the terminal housing. In order to mechanically join the connection terminals to the adjacent modular terminals, preferably on the clip housings of the connection terminals catch elements are also formed which correspond to catch recesses and/or drop-in pins in the terminal housing of the modular terminals.

The terminal housings of the modular terminals also preferably have one insertion bevel each, with which the terminal housing in the mounted state of the modular terminals sit on the lower inside edge of the wall opening. Since insertion bevels which are made on the terminal housings of the modular terminals simplify not only the preliminary mounting of the modular terminal block in the wall opening, as already described in conjunction with the connection terminal, but they also enhance the retention of the mounting block in the wall opening. If specifically during operation a plug of a test plug or service plug is plugged into a modular terminal, the insertion bevel which is made on the bottom of the terminal housing of the modular terminal prevents deflection of the modular terminal block as a result of the insertion force which occurs when the plug is plugged in. The insertion forces are accommodated by the insertion bevel at least partially from the lower edge of the wall opening so that deflection of the modular terminal block is prevented or at least reduced.

According to another advantageous configuration of the unit in accordance with the invention, on the terminal housings of the modular terminals on the side opposite the opening for the plug of a test plug or service plug at least one laterally projecting catch element is made which interlocks with a mating catch element of an adjacent modular terminal. The catch element here runs essentially parallel to the housing wall or to the plane of the wall opening, because the individual catch elements project laterally somewhat to the terminal housing of the adjacent modular terminal the interlocking of the modular terminals which have been connected to form a modular terminal block taking place which likewise counteracts deflection of the modular terminal block when a test plug or service plug is inserted. Preferably, at least one corresponding catch element which projects to one side is also made on the clip housings of the connection terminals, this catch element interlocking with a mating catch element of an adjacent modular terminal.

In particular there is now a host of possibilities for embodying and developing the connection terminal in accordance with the invention and the unit. For this purpose reference is made to the following description of a preferred exemplary embodiment in conjunction with the drawings.

DETAILED DESCRIPTION OF THE INVENTION

Figure 1:
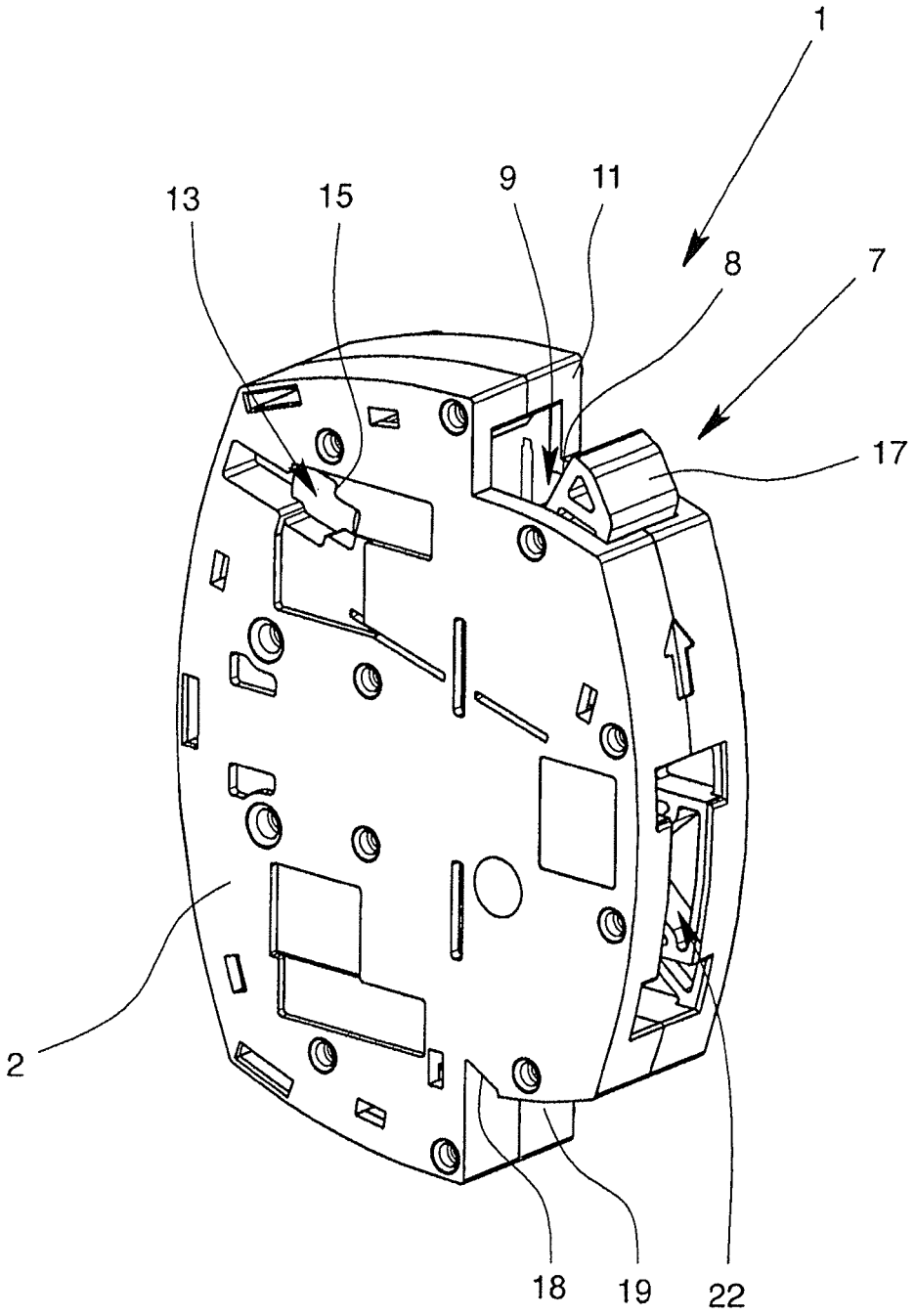
FIG. 1 is a perspective of a connection terminal in accordance with the invention.
Figure 2:
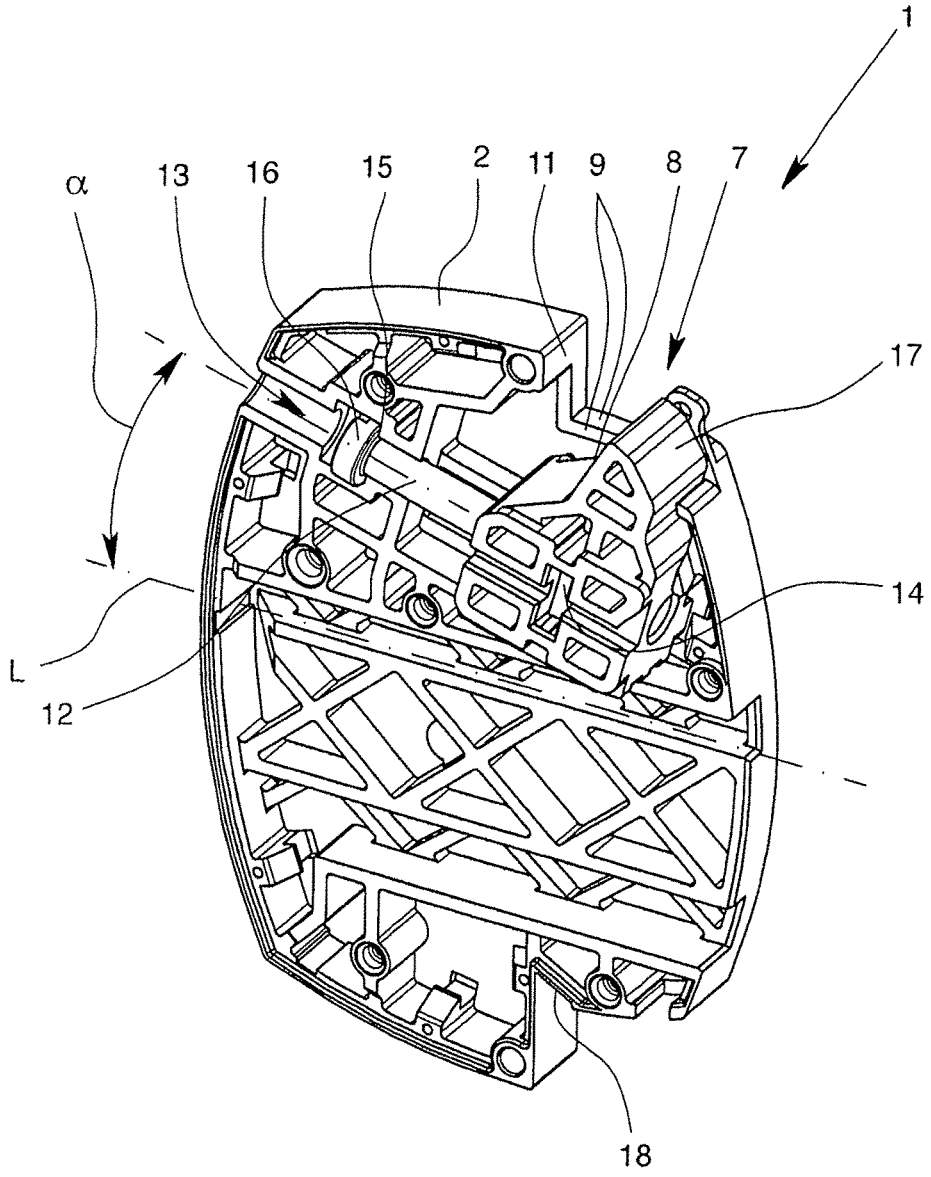
FIG. 2 shows the connection terminal according to FIG. 1, with the housing opened.
Figure 4:
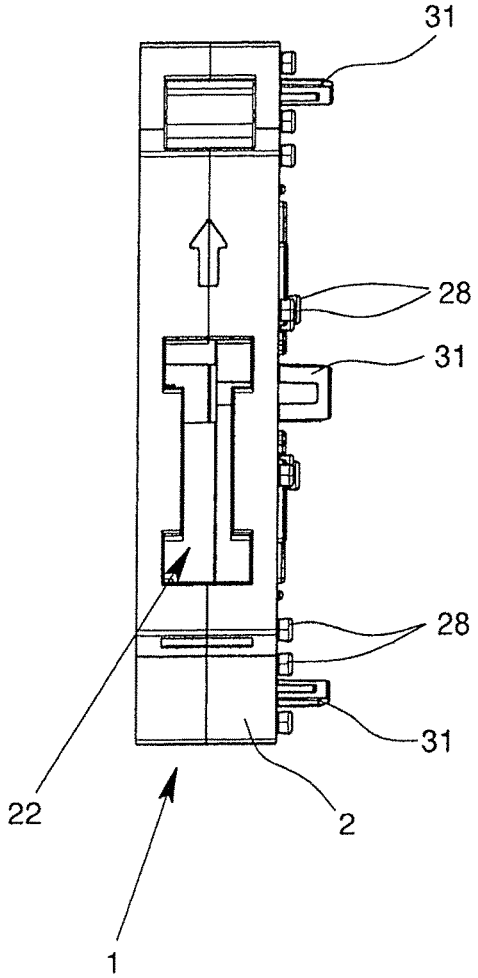
FIG. 4 shows the connection terminal from the operator side.
Figure 5:
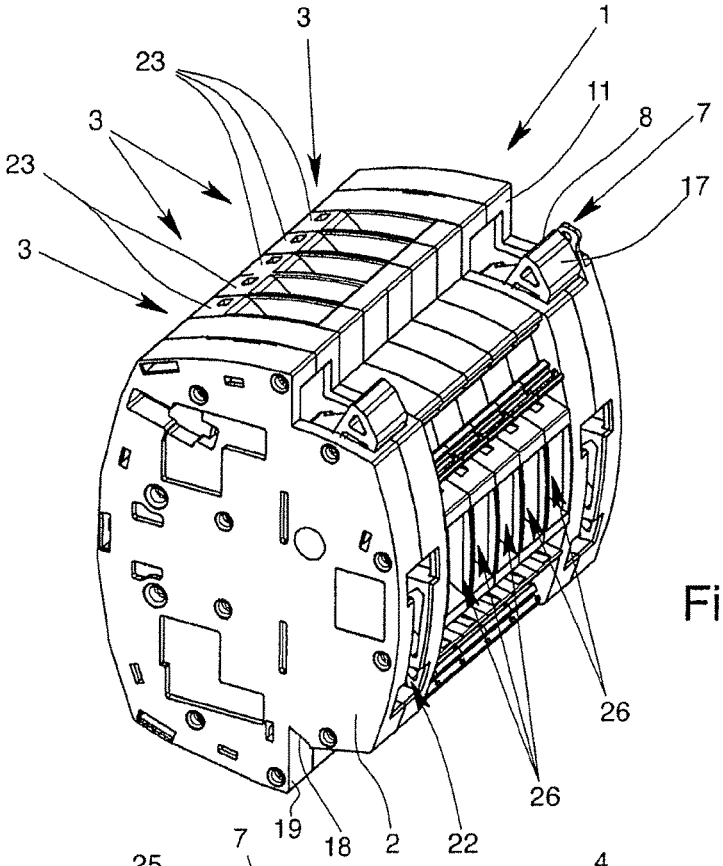
FIG. 5 is a perspective view obliquely from the operator side of a unit formed of a modular terminal block and two connection terminals in accordance with the invention.
Figure 6:
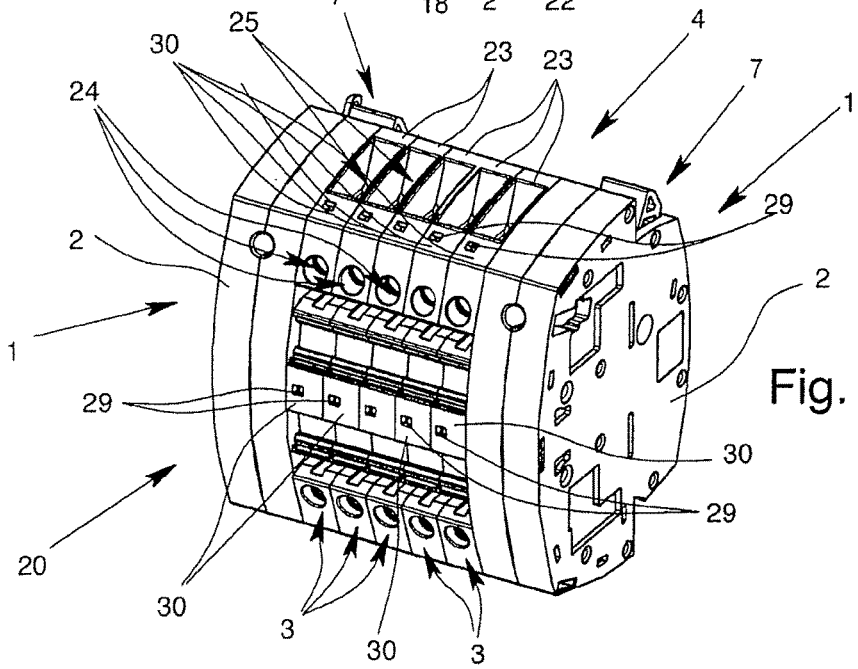
FIG. 6 is a perspective view obliquely from the wiring side of the unit according to FIG. 5.
Figure 8:
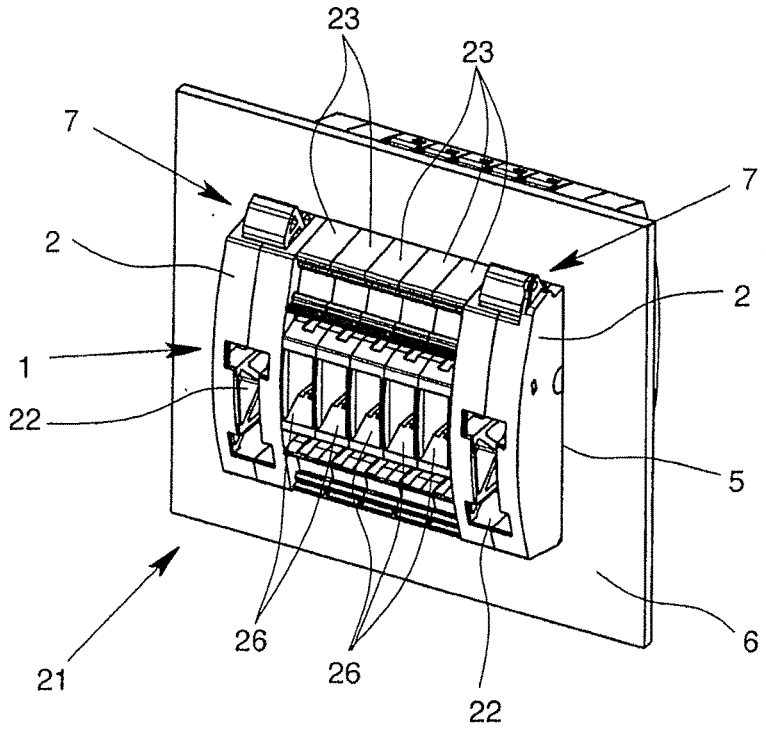
FIG. 8 is a perspective view from the operator side of the unit according to FIG. 5, inserted into a wall opening of a housing wall.
Figure 9:
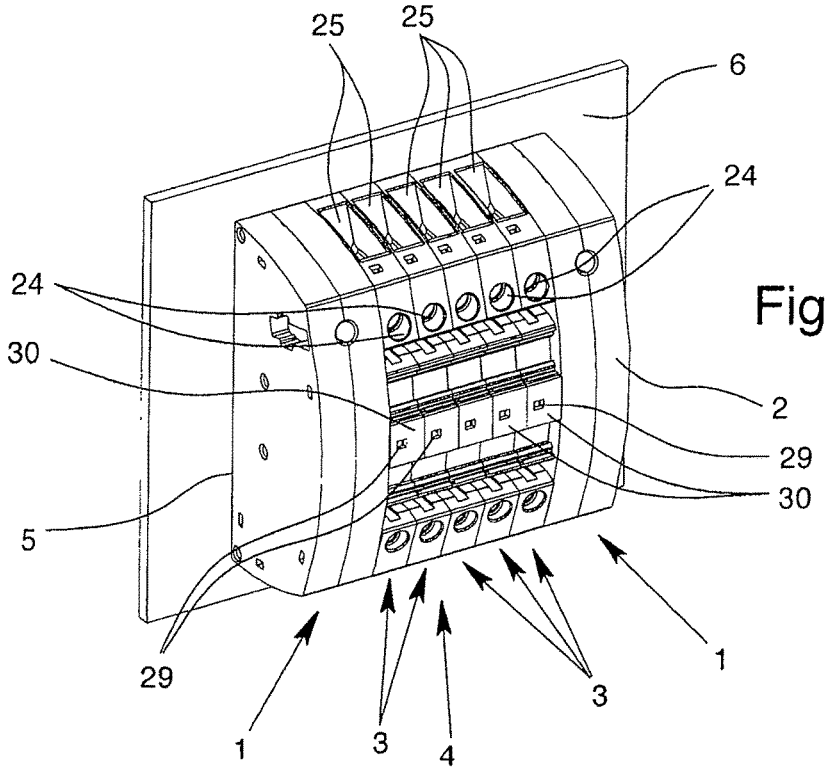
FIG. 9 is a perspective view of the unit according to FIG. 8 from the wiring side.

FIGS. 1, 2 and 4 each show a connection terminal 1 in accordance with the invention with a clip housing 2, the connection terminal 1 being used to fix a modular terminal block 4 form of several modular terminals 3 in a wall opening 5 of a housing wall 6. A unit formed of two connection terminals 1 and a modular terminal block 4 having several modular terminals 3 is shown in FIGS. 5 and 6 as well as FIGS. 8 and 9, FIGS. 8 and 9 showing the unit in the state mounted in the wall opening 5.

Figure 3:
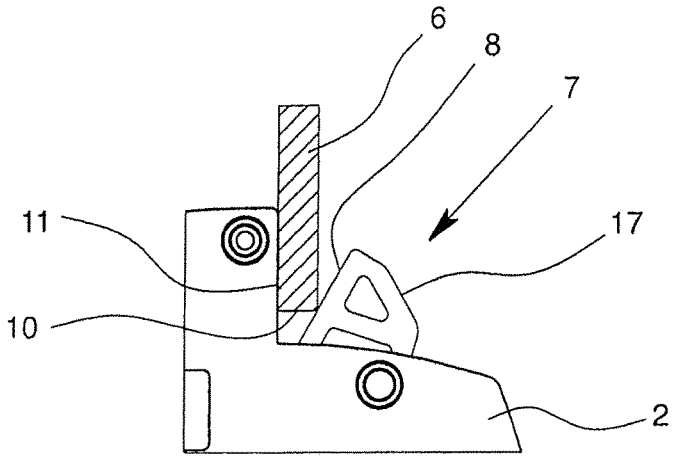
FIG. 3 is an enlarged view of part of the connection terminal, with part of a housing wall.

Within the clip housing 2 of the connection terminal 1, which housing is formed of two half shells, a fixing element 7 is movably located such that, in the clamping position of the fixing element 7 shown in FIG. 3, a clamping bevel 8, which projects through an opening 9 in the clip housing 2, acts against a lower inside edge 10 of the wall opening 5. The housing wall 6 which borders the wall opening 5 is clamped between the clamping bevel 8 and a contact surface 11 which is made on the clip housing 2 so that the connection terminal 1 is fixed in the wall opening 5 in the clamping position of the fixing element 7 shown in FIG. 3. Because there is a clamping bevel 8 as the clamping surface, the connection terminal 1 is fixed not only in the horizontal direction, but additionally also in the vertical direction since the clip housing 2 is also pressed down against the lower inside edge of the wall opening 5 by the clamping bevel 8.

It is apparent from the opened representation of the connection terminal 1 as shown in FIG. 2 that in the preferred illustrated exemplary embodiment there is a screw 12 as the actuating element which is located in a hole 13 which is accessible from the outside in the clip housing 2. A nut 14 which corresponds to the screw 12 is locked against rotation in the fixing element 7, and the end of the screw 12 is screwed into it. Because the hole 12 for the screw 12 has a contact shoulder 15 to which the screw head 16 is adjacent, the screw 12 is fixed in the longitudinal direction so that twisting of the screw 12 does not lead to a longitudinal displacement of the screw 12, but to a displacement of the fixing element 7 in the longitudinal direction of the screw 12. In this way, the fixing element 7 after insertion of the connection terminal 1 into the wall opening 5 can be drawn with its clamping bevel 8 against the lower inside edge 10 of the wall opening 5, as a result of which the connection terminal 1 is fixed in the wall opening 5.

Moreover, it is apparent from FIG. 2 that the longitudinal direction of the screw 12, and thus the displacement direction of the fixing element 7, run at an angle $\alpha$ relative to the surface normal of the wall opening 5 and thus also to the longitudinal axis L of the connection terminal 1. In this way, the dimensional tolerances of the wall opening 5 in which the connection terminal 1 can be inserted and fastened can be still larger than would be the case in a displacement direction of the fixing element 7 parallel to the longitudinal axis L of the connection terminal 1.

According to another configuration, the side of the fixing element 7 opposite the clamping bevel 8 has a lead-in bevel 17 which is inclined oppositely to the clamping bevel 8. In this way, the connection terminal 1 can be more easily inserted into a wall opening 5 of a housing wall 6, for example, the door of a switchgear cabinet. The execution of the lead-in bevel 17 also reduces the risk of a collision with the housing of a test plug which is to be plugged into an opening 26 in the terminal housing of a modular terminal 3. Moreover, in the clip housing 2, on the lower side which is opposite the opening 9 for the clamping bevel 8 of the fixing element 7, an insertion bevel 18 is formed with which the clip housing 2 sits on the lower inside edge of the wall opening 5 in the mounted state of the connection terminal 1.

If the connection terminal 1 or a unit of two connection terminals 1 and a modular terminal block 4 which is located in between is inserted into a wall opening 5, first the upper section of the unit with the two fixing elements 7 can be inserted through the wall opening 5, and then, the unit can be pivoted in the direction toward the housing wall 6 such that the connection terminals 1, with their insertion bevels 18, sit on the lower inside edge of the wall opening 5. The contact surface 11 which is opposite the clamping bevel 8 and the lower contact surface 19 which borders the insertion bevel 18 are located on the first side, the wiring side 20 of the housing wall 6, while the clamping bevel 8 of the fixing element 7 is located on the second side, the operator side 21. The part of the fixing element 7 which projects through the opening 9 in the clip housing 2, which part has the clamping bevel 8 and the insertion bevel 17, prevents the unit from falling out of the wall opening 5 even if the fixing element 7 has still not yet been moved into the clamping position.

On the operator side 21, in the clip housing 2, moreover, a coding opening 22 is formed for insertion of a coding element which is made on the test plug, the coding opening 22 being arranged off-center relative to the longitudinal axis L of the connection terminal 1 so that the coding opening 22 implements 180° coding, i.e., a test plug block can only be slipped onto the modular terminal block 4 in one orientation and not in the wrong orientation turned by 180°, The unit which is shown in FIGS. 5 and 6 has two connection terminals 1 and several modular terminals 3, five in the illustrated exemplary embodiment, which are connected to one another, which form a modular terminal block 4 and each of has a terminal housing 23. In each of the terminal housings 23, there are two conductor connection elements, which are screw-type terminals in the illustrated exemplary embodiment, of which the actuating openings 24 for the screws and on the upper side the conductor insertion openings 25 can be recognized in FIGS. 6 and 9. Moreover, in FIGS. 5 and 8, further openings 26 in the terminal housings 23 of the modular terminals 3 can be recognized; they are made for plugging the plug of a test plug or service plug into the elastic contact regions within the modular terminals 3.

Figure 7:
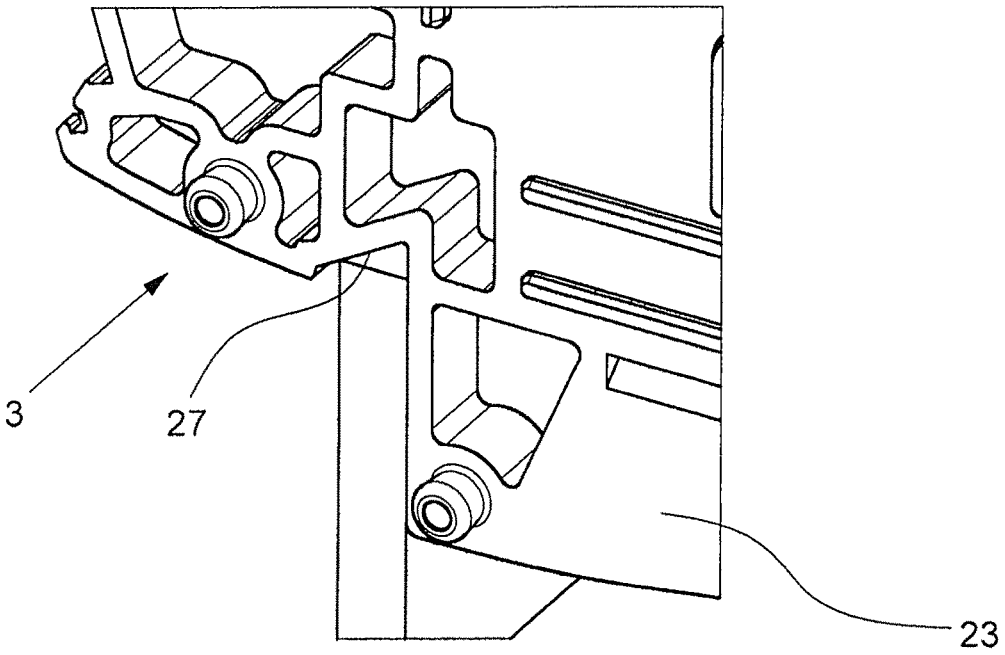
FIG. 7 shows an enlarged extract of a modular terminal.

In order to facilitate the fixing of the modular terminal block 4 and especially its preliminary mounting in the wall opening 5, the terminal housings 23 of the modular terminals 3 also have an insertion bevel 27 on each of which the terminal housings 23 sit on the lower inside edge of the wall opening 5. The execution of the insertion bevel 27 in the terminal housing 23 of a modular terminal 3 which corresponds in its configuration to the insertion bevel 18 in the clip housing 2 of the connection terminal 1 is shown in FIG. 7.

To fix the connection terminals 1 with the modular terminals 3, on the clip housing 2 of the connection terminals 1, catch elements in the form of drop-in pins 28 are made which lock into corresponding catch recesses (not shown here) in the adjacent side wall of the terminal housing 23 of an adjacent modular terminal 3. Accordingly, the fixing of the individual modular terminals 3 among one another to form a modular terminal block 4 also takes place by corresponding catch elements which are made on the terminal housings 23, especially in the form of drop-in pins which are located on a side of the terminal housings 23 and corresponding catch recesses which are made in the other side of the terminal housings 23, as is fundamentally known in modular terminals.

Moreover, in the modular terminals 3 of the modular terminal block 4 which are shown in the figures, additional fixing among one another takes place by catch elements 29 which each interlock with a mating catch element 30 of an adjacent modular terminal 3 being made on the side opposite the opening 26 for the plug of a test plug or service plug, i.e., the wiring side 20, on the terminal housing 23. The catch elements 29 project to one side of the terminal housing 23 such that the catch elements 29 and the mating catch elements 30 overlap in the manner of scales, as a result of which deflection of the modular terminal block 4 is prevented or at least reduced when a plug is inserted into the opening 26. There is also corresponding interlocking preferably between a connection terminal 1 and the adjacent modular terminal 3, for which several catch elements 31 (FIG. 4) are made on the clip housing 2 of the connection terminal 1 and which project to one side and each of which interlocks with a mating catch element of an adjacent modular terminal 3.

What is claimed is:

1. A connection terminal, comprising:

a clip housing for fixing a modular terminal block having several modular terminals that are mountable in a wall opening of a support wall, wherein a fixing element is located in the clip housing, the fixing element having a clamping bevel which projects through an opening in the clip housing, and wherein the fixing element is movable by an actuating element into a clamping position in which the clamping bevel has a clamping surface that acts at an inclined angle against an inside edge of the wall opening in the mounted state of the connection terminal and out of said clamping position to enable dismounting of the connection element from the wall, and wherein the clip housing having a contact surface which is opposite to the clamping bevel and parallel to the support wall in the mounted state, and wherein the actuating element can be actuated for moving the fixing element into and out of said clamping position from the same side of the wall opening from which the connection terminal is first inserted into the wall opening.

2. The connection terminal as claimed in claim 1, wherein the actuating element is a screw in a hole in the clip housing that is accessible from outside of the clip housing, and wherein a nut is locked against rotation in the fixing element and into which an end of the screw is screwed, and where the hole is constructed such that the screw is fixed in a longitudinal direction so that rotation of the screw causes displacement of the fixing element.

3. The connection terminal as claimed in claim 1, wherein a displacement direction of the fixing element runs at an acute angle to a surface normal of the wall opening and to a longitudinal axis of the connection terminal.

4. The connection terminal as claimed in claim 1, wherein the fixing element has a lead-in bevel on a side opposite the clamping bevel.

5. The connection terminal as claimed in claim 1, wherein the clip housing has an insertion bevel on a side opposite the wall opening and with which the clip housing sits on a lower inside edge of the wall opening in said mounted state of the connection terminal.

6. The connection terminal as claimed in claim 1, wherein a coding opening is provided in the clip housing for insertion of a coding element.

7. The connection terminal as claimed in claim 6, wherein the coding element is provided on a mounting element of a test plug block.

8. The connection terminal as claimed in claim 7, wherein a contact surface on the clip housing which is opposite the clamping bevel extends parallel to the support wall.

9. A unit comprising two connection terminals and several modular terminals which are located next to one another in at least one modular terminal block, the modular terminals being located between the connection terminals and having a respective terminal housing with at least two conductor connection elements located therein, wherein each of the connection terminals comprises a clip housing for fixing the at least modular terminal block, the at least one modular terminal block being mountable in a wall opening of a support wall, wherein a fixing element is located in the clip housing, the fixing element having a clamping bevel which projects through an opening in the clip housing, wherein the fixing element is movable by an actuating element into a clamping position in which the clamping bevel has a clamping surface that acts at an inclined angle against an inside edge of the wall opening in the mounted state of the connection terminal, wherein the clip housing has a contact surface which is opposite the clamping bevel and parallel to the support wall in the mounted state, and wherein the actuating element can be actuated from the same side of the wall opening from which the connection terminal is first inserted into the wall opening.

10. The unit as claimed in claim 9, wherein an insertion bevel is provided in the terminal housing of the modular terminals, with which the terminal housings sit on a lower inside edge of the wall opening in the mounted state of the modular terminals.

11. The unit as claimed in claim 9, wherein the modular terminals are mechanically connected to one another via corresponding catch elements on the terminal housings.

12. The unit as claimed in claim 11, wherein the catch elements comprise drop-in pins which are located on one side of the terminal housings and corresponding catch recesses which are located in the other side of the terminal housings.

13. The unit as claimed in claim 9, wherein connection terminals are connected mechanically to an adjacent modular terminal via catch elements on the clip housings.

14. The unit as claimed in claim 13, wherein the catch elements comprise drop-in pins which are located on one side of the terminal housings and corresponding catch recesses which are located in the other side of the terminal housings.

15. The unit as claimed in claim 9, wherein at least one catch element is provided on the terminal housings of the modular terminals on the side opposite the opening for the plug of a test or service plug, the at least one catch element projecting to one side and interlocking with a mating catch element of an adjacent modular terminal.

16. The unit as claimed in claim 9, wherein at least one catch element is provided on the clip housings of the connection terminals, the at least one catch element projecting to one side and interlocking with a mating catch element of an adjacent modular terminal.

* * * * *